United States Patent [19]

Connelly

[11] 4,245,357

[45] Jan. 20, 1981

[54] CURVED GLOVE CONSTRUCTION

[75] Inventor: John R. Connelly, Deerfield, Ill.

[73] Assignee: Marmon Company, Chicago, Ill.

[21] Appl. No.: 39,168

[22] Filed: May 15, 1979

[51] Int. Cl.[3] ..... A41D 19/00

[52] U.S. Cl. ..... 2/163

[58] Field of Search ..... 2/163, 158, 159, 167, 2/169

[56] References Cited

U.S. PATENT DOCUMENTS

| | | | |
|---|---|---|---|
| 2,617,109 | 11/1952 | Slimovitz | 2/163 |
| 4,123,803 | 11/1978 | Reinehart | 2/163 |

FOREIGN PATENT DOCUMENTS

| | | | |
|---|---|---|---|
| 155568 | 3/1954 | Australia | 2/163 |
| 2346444 | 3/1975 | Fed. Rep. of Germany | 2/163 |

*Primary Examiner*—Doris L. Troutman

*Attorney, Agent, or Firm*—Pennie & Edmonds

[57] ABSTRACT

A curved gunn-cut glove construction wherein the fingers of the glove curve inwardly towards the palm portion of the glove to conform to the configuration of a hand when in a relaxed state. The palm piece of the glove including the front portions of the first and fourth fingers are joined to a back piece including the back portion of the first, second, third and fourth fingers as well as to a middle piece including the front portions of the second and third fingers. The back portion of each of the fingers is longer in length than its associated front portion. The base part of each of the second and third front finger portions has a concave edge and is joined to a complementary concave shaped edge of the palm piece. The stitching distance joining the front and back portions of each finger are equalized notwithstanding that the back portion is longer than the front portion. In addition the palm piece of the glove extending between the thumb joint and the finger joints is shorter than the associated back piece of the glove to further enhance the curved effect of the glove and to reduce bunching of the palm of the glove when the glove is in the clasped position.

2 Claims, 6 Drawing Figures

CURVED GLOVE CONSTRUCTION

TECHNICAL FIELD

The invention relates to a gunn-cut glove construction shaped to conform to the natural curved configuration of a hand when in a relaxed state and specifically such that the fingers of the glove in a relaxed state will be curved inwardly towards the palm and without bunching of the palm portion of the glove when the glove is moved to a clasping position.

BACKGROUND ART

Gunn-cut gloves have been cut in the past and the parts sewn together flat such that in the finished assembled state, the gloves have straight extending fingers. Such gloves however are not as confortable to wear as fashioned gloves which follow the natural contour of the hand in a relaxed state. Gloves have been constructed in the past to follow the contour of the hand in the relaxed state but such gloves have been expensive to make. For example high fashion gloves utilizing separate fourchette portions between the front and back parts of the fingers have been utilized where the fourchettes are curved such that the resulting glove configuration will have curved fingers. The use of separate fourchettes necessarily increases the expense of manufacturing gloves and, because of their curved shape, require a high degree of operator skill in sewing the parts together.

Further, curved gloves have been made in the past by molding processes to give the glove a shape to conform generally with the natural contour of the hand when in a relaxed state. For example single piece rubber gloves have been molded but such molding procedures are not applicable for making cloth or leather gloves.

It is therefore an object of the invention to provide a glove construction utilizing the simplicity and ease of assembly of conventional gunn-cut constructions the parts of which are adaptable to being sewn together in the flat and at the same time to provide modifications of the parts making up the gunn-cut construction to provide for a curved construction which heretofore has only been available in molded gloves or involved fourchette constructions.

DISCLOSURE OF THE INVENTION

Broadly the invention comprises utilizing a gunn-cut glove construction comprising a palm piece, a middle piece and a back piece. The palm piece includes the first and fourth front finger portions which form the front parts of the first and fourth fingers of the glove. The back piece includes first, second, third, and fourth back finger portions which form the back parts of the corresponding fingers. A middle piece is included which forms the front portions of the second and third fingers. The palm piece, middle piece and back piece are stitched together around their peripheries to form the glove and, to this extent, the construction is similar to a conventional gunn-cut glove. In order to impart a curved configuration to the fingers of the glove, the longitudinal distance of the front portion of each of the fingers of the glove is cut shorter than the longitudinal distance of the associated back portion of each of the fingers and during the sewing operation, the stitching distance joining the edges of the front and back portions is equalized to accommodate for the difference in length between the front and back portions. This equalization of the sewing distance may be achieved by utilizing a compound feed sewing machine which feeds a back finger portion to the stitching needle at a faster rate of speed than its associated front finger portion when the two portions are stitched together or in the alternative, by pulling and longitudinally stretching each front finger portion while it is stitched to its back finger portion.

In addition the palm portion extending between the joint line of the fingers and the thumb joint line is shorter than the back portion extending between the same joint lines to further give a curved shape to the glove, and, as in the case with the finger portions, the sewing distances along the lateral edge of the palm piece and back piece between the joint lines are equalized.

The lower edge of the base of the front finger portions of each of the second and third fingers of the middle piece has a concave edge and is joined by stitching to a similar or complementary concave edge formed by a cutout in the palm piece. This construction along with the shortened palm piece reduces bunching of the palm piece when the hand within the glove is clasped and the stitching of the front portions of the second and third fingers to the edge of the cutout in the palm piece enhances the curved effect in that it forces the second and third glove fingers to fold inwardly towards the palm piece.

After the separate parts of the glove have been sewn together, the curved shape of the glove may be set by mounting the glove on a heated mold conforming in shape to a hand in the relaxed state. This is particularly advisable when the parts making up the glove are leather.

BEST MODE FOR CARRYING OUT THE INVENTION

Figure 1:
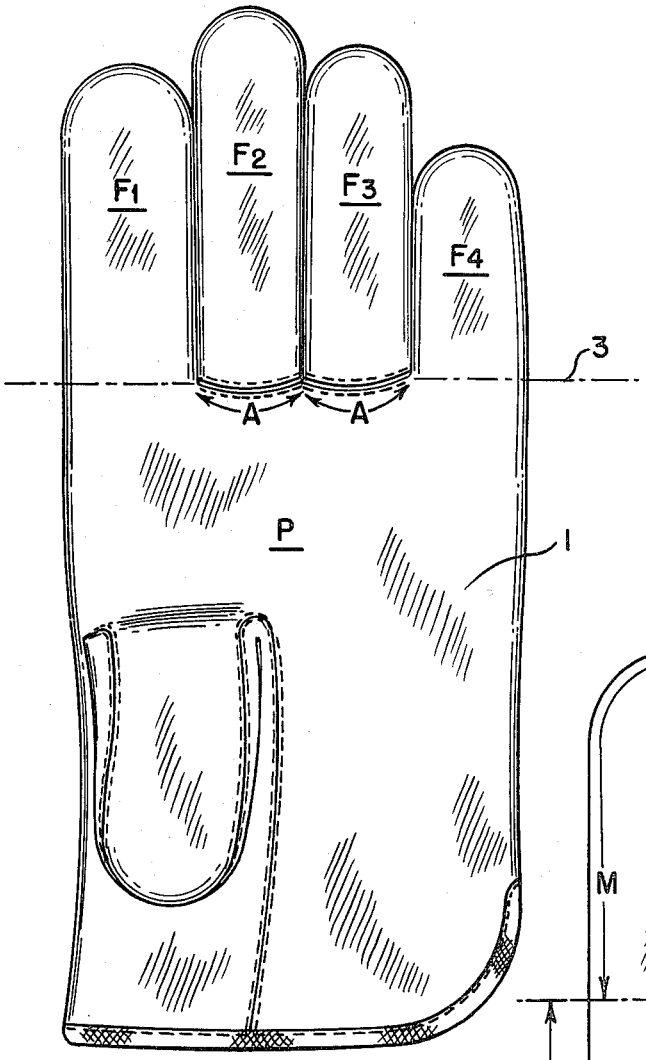
FIG. 1 is a plan view of a glove constructed according to the invention illustrating the palm side.

Referring to FIG. 1 there is illustrated a gunn-cut glove having a palm piece 1 including the front portions $F_1$, $F_2$, $F_3$ and $F_4$ of the four fingers of the glove.

Figure 2:
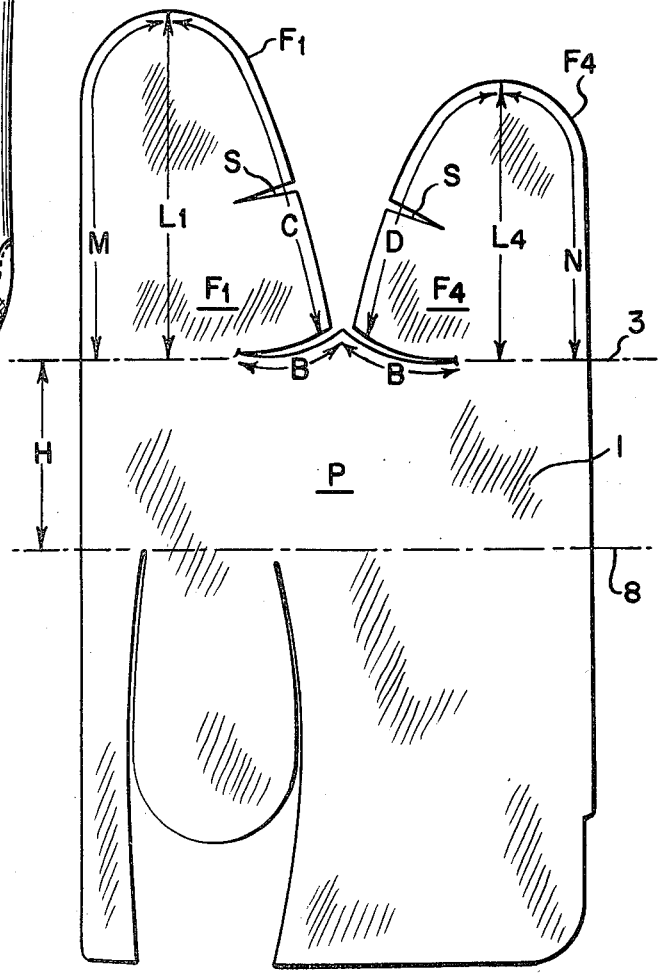
FIG. 2 is a plan view of the palm piece of the glove of FIG. 1 in the flat.

Referring to FIG. 2 the palm piece is illustrated after being cut and before stitching to other pieces, and as shown, the front finger portions $F_1$ and $F_4$ have a length $L_1$ and $L_4$ measured from the tip of the fingers to the finger joint line corresponding to the finger joint line of a hand.

Figure 3:
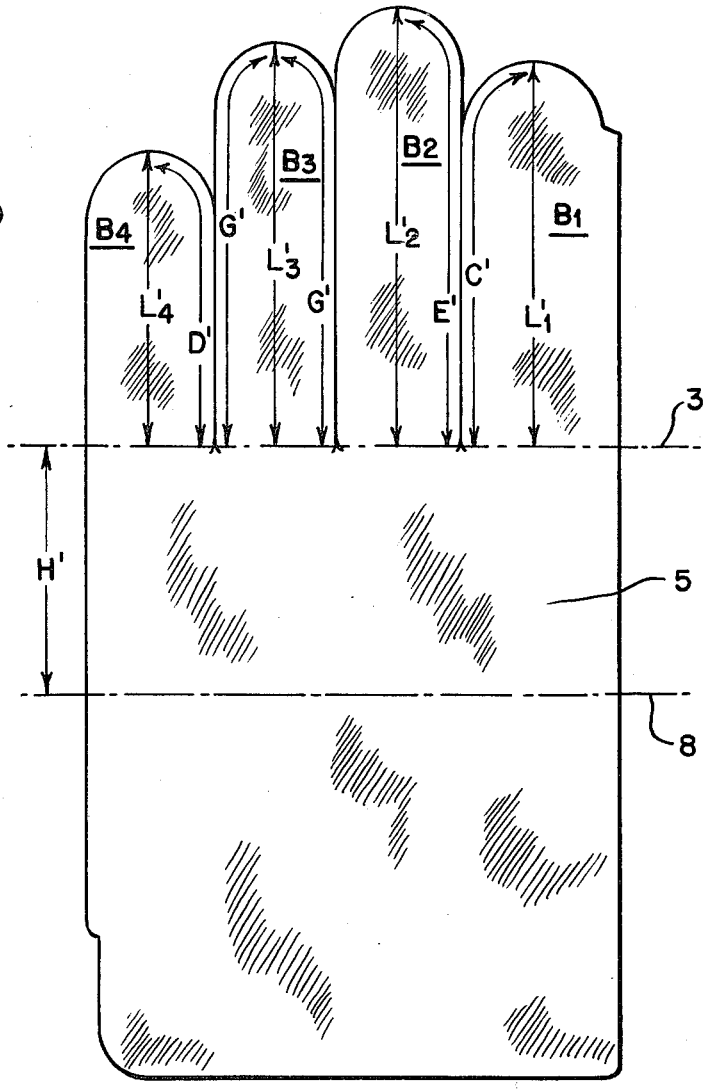
FIG. 3 is a plan view of the back piece of the glove of FIG. 1 in the flat.

Referring to FIG. 3 the back piece 5 of the glove has back finger portions $B_1$, $B_2$, $B_3$ and $B_4$ forming the back portions of the four fingers of the glove where each finger portion has a length $L'_1$, $L'_2$, $L'_3$ and $L'_4$ measured from the end of the finger portions to the finger joint line 3.

Figure 4:
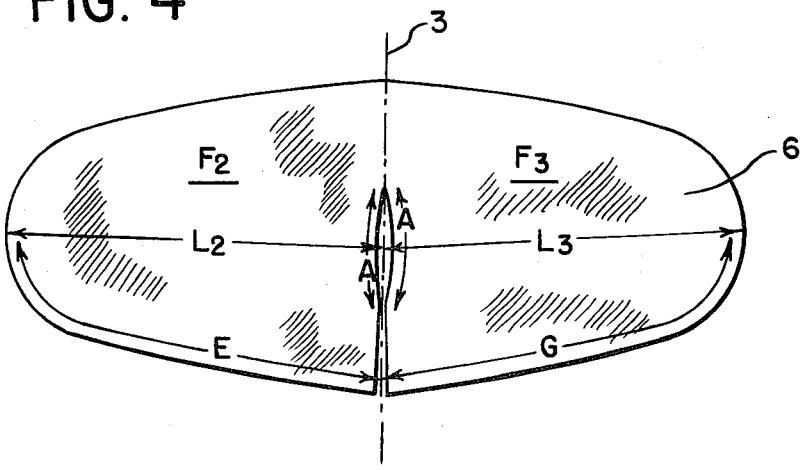
FIG. 4 is a plan view of the middle piece of the glove of FIG. 1 in the flat.
Figure 5:
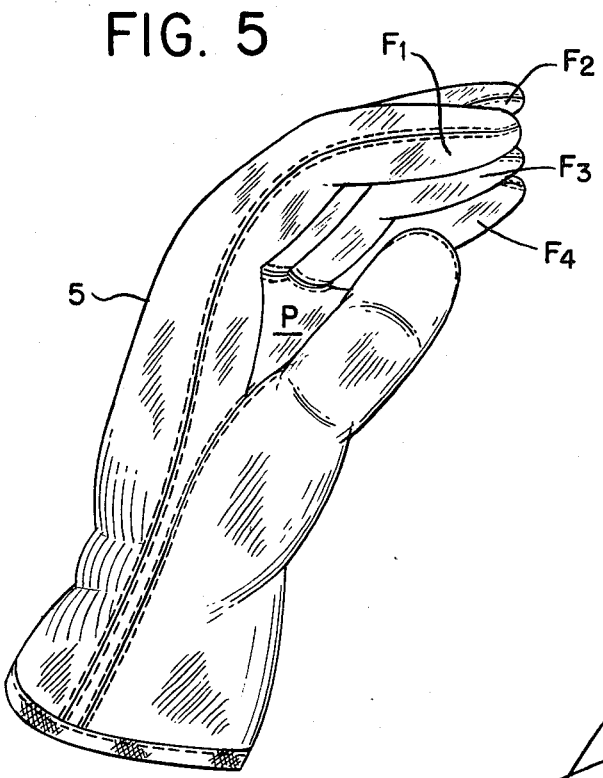
FIG. 5 is a side view of the glove of FIG. 1 illustrating the curved features of the glove.
Figure 6:
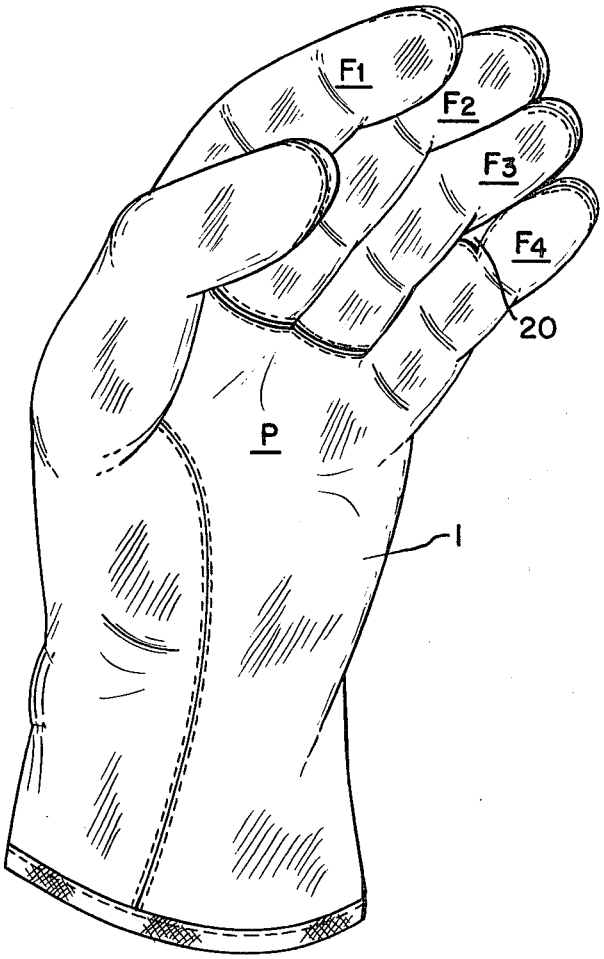
FIG. 6 is a perspective view of the glove of FIG. 1.

The middle piece 6 of the glove as illustrated in FIG. 4 and which forms the front portions $F_2$ and $F_3$ of the second and third fingers is shaped such that the front portion $F_2$ has a length $L_2$ as measured from the end of the finger to the finger joint line 3 and a length $L_3$ for the front portion $F_3$ as similarly measured.

A feature of the construction is that the edges A which form the lower end of each of the front portions of the second and third fingers is shaped in a concave fashion so as to form concave edges as shown. These concave edges A when assembled to the palm piece by stitching complement similar concave edges B of the palm piece as shown in FIG. 2 and enhance the curved configuration of the glove when the parts are sewn together.

A further feature of the construction is that the lengths $L'_1$–$L'_4$ of the back portions of the fingers are greater than the lengths $L_1$–$L_4$ of the front portions of the fingers. In order that the front and back portions may be sewn together without any wrinkling of the parts, it is necessary that the stitching distance around the periphery of each back finger portion be equalized with the stitching distance around the periphery of each associated front finger portion. Thus, as shown in FIG. 2 the stitching distance C would be equalized with the stitching distance C' of the back portion $B_1$ as shown in FIG. 3 and the stitching distance D of the front portion $F_4$ would be equalized with the stitching distance D' of the back portion $B_4$ shown in FIG. 3. Similarly the stitching distance E of the front portion $F_2$ of the second finger would be equalized with the stitching distance E' of the back portion $F_2$ of the second finger and the stitching distance G of the front portion $F_3$ would be equalized with the stitching distance G' of the back portion $B_3$ of the third finger. For clarity, the stitching distance of only one-half the periphery of each finger portion has been described, it being understood that the equalization of the sewing distance feature for the other half of the peripheries would apply. Equalization of the sewing distances along the peripheries of the front and back portions requires that during the sewing operation, the front portions be stretched while being sewn to the back portion. In the alternative, a compound feed sewing machine may be used where the machine feeds the back portions to the sewing needle at a faster rate than the front portions.

Further it is desirable that the longitudinal distance H of the palm portion P of the palm piece 1 extending between the finger joint line 3 and the thumb joint line 8 be less than the distance H' between the part of the back piece opposite the finger joint line and thumb joint line. It is necessary, as in the case of sewing the finger portions together, that the sewing distance H between the finger joint line and the thumb joint line along the lateral edges of the palm piece be equalized with the sewing distance H' extending between the joint lines on the back piece and along the lateral edges of the back piece. This is achieved by stretching the palm piece during the sewing assembly of the pieces or by feeding the back piece at a faster speed towards the machine needle than the front piece on a compound feed sewing machine. This difference in length of the palm piece with respect to the back piece further enhances the glove taking a curved configuration in a relaxed state and also reduces bunching of the palm portion when a hand on which the glove is worn is clasped.

A glove constructed according to the invention thus has the advantages of a conventional gunn-cut construction, namely that the parts comprising the glove can be sewn together in the flat, while, still at the same time, imparting a curved shaped to the glove which heretofore has only been accomplished by molding or by the inclusion of separate curved fourchettes which prevented sewing in the flat.

I claim:

1. A gunn-cut glove construction having a palm piece including first and fourth front finger portions forming the front parts of the first and fourth fingers of the glove, a back piece including first, second, third and fourth back finger portions forming the back parts of the first, second, third and fourth fingers of the glove, and a middle piece including second and third front finger portions forming the front parts of the second and third fingers of the glove with said palm piece, back piece and the middle piece being stitched together about part of their peripheries to form said glove; the improvement comprising in that the longitudinal length of each back finger portion forming part of an individual finger is greater than the longitudinal length of an associated front finger portion, in that a part of the base of each of the second and third front finger portions of the middle piece has a concave edge, in that part of the periphery of said palm piece adjoining each said base is curved in a concave shape, and in that the stitching distance around the periphery of each front piece portion forming part of an individual finger is equalized with the stitching distance of an associated back finger portion whereby the fingers of said glove are curved inwardly.

2. A gunn-cut glove construction according to claim 1, wherein said glove in addition has a thumb portion connected to the palm piece along a thumb joint line, the improvement further comprising in that the longitudinal distance of the palm piece extending between the finger joint line and the thumb joint line is less than the longitudinal distance of the back piece extending between a point on said back piece opposite said finger joint line and a point on said back piece opposite said thumb joint line and in that the stitching distance of the palm piece is equalized with the stitching distance of the back piece along edges of the glove equal to said longitudinal distance.

* * * * *